US007971764B2

(12) United States Patent
Sabbah

(10) Patent No.: US 7,971,764 B2
(45) Date of Patent: Jul. 5, 2011

(54) BACKPACK FOR SNOW SKIS AND BOOTS

(75) Inventor: Dan Sabbah, New York, NY (US)

(73) Assignee: Global Design Concepts, Inc., New York, NY (US)

( * ) Notice: Subject to any disclaimer, the term of this patent is extended or adjusted under 35 U.S.C. 154(b) by 664 days.

(21) Appl. No.: 12/033,117

(22) Filed: Feb. 19, 2008

(65) Prior Publication Data

US 2009/0206118 A1 Aug. 20, 2009

(51) Int. Cl.
*A45F 3/04* (2006.01)

(52) U.S. Cl. ..... 224/650; 224/652; 224/917

(58) Field of Classification Search ..... 224/627, 224/645, 650, 651, 652, 917; D3/261, 221; *A45F 3/04*

See application file for complete search history.

(56) References Cited

U.S. PATENT DOCUMENTS

| | | | | |
|---|---|---|---|---|
| 4,746,159 | A | 5/1988 | Webb et al. | |
| 4,982,883 | A | 1/1991 | Ullal et al. | |
| 5,012,921 | A | 5/1991 | Becker | 206/315.1 |
| 5,027,481 | A | 7/1991 | Frano | |
| 5,309,610 | A | 5/1994 | le Gal | |
| 5,538,137 | A | 7/1996 | Deioma et al. | 206/579 |
| 5,779,036 | A | 7/1998 | Westbrook et al. | 206/292 |
| 5,826,771 | A | 10/1998 | Peng | 224/651 |
| D400,706 | S | 11/1998 | Seider | D3/254 |
| 5,881,708 | A | 3/1999 | Kliot | |
| 6,712,250 | B2 | 3/2004 | Vigny | 224/640 |
| 6,786,375 | B2 | 9/2004 | Worden et al. | 224/627 |
| 6,863,201 | B2 | 3/2005 | Esqueda | |
| 7,165,705 | B2 | 1/2007 | Haro | 224/629 |
| 2002/0104859 | A1 | 8/2002 | Kelliher et al. | 224/148.2 |
| 2002/0113102 | A1 | 8/2002 | Klamm | 224/153 |
| 2006/0208024 | A1 | 9/2006 | Gleason, Jr. | 224/633 |
| 2010/0176172 | A1 | 7/2010 | Gleason, Jr. | 224/635 |

*Primary Examiner* — Justin M Larson
(74) *Attorney, Agent, or Firm* — Ladas & Parry LLP

(57) ABSTRACT

A backpack shell construction having a stiff back panel supporting storage compartments projecting outwardly therefrom and carried on the user's back by a pair of shoulder straps and further secured to the user by a waist strap, to which shell a pair of tandem collapsible boot shelves or platforms are integrated at lower corner portions and an outer ski carrier and helmet mounting panel is hingedly attached to the front face of the backpack shell.

12 Claims, 6 Drawing Sheets

BACKPACK FOR SNOW SKIS AND BOOTS

The present invention relates to backpack constructions especially configured to carry ski boots and snow skis by a skier/hiker.

BACKGROUND OF THE INVENTION

The state of the backpack art is well-developed and includes teachings of various sizes, shapes, and carrying strap configurations to accommodate specific loading situations and particular equipment to be transported including sporting goods and the like. For example, U.S. Pat. No. 5,881,708 is directed to an arrangement for carrying bulky, heavy footwear such as ice skates and ski boots. U.S. Pat. No. 4,982,883 is directed to a fanny-pack with a shoulder harness allowing a skier to carry skis on the body. U.S. Pat. No. 4,746,159 is directed to a combination skis and boot bag suitable for hand carriage as a piece of luggage. U.S. Pat. No. 6,863,201 shows a backpack with a headgear mounting flap. Quick-release buckle hardware for usage in backpacks is shown in U.S. Pat. Nos. 5,027,481 and 5,309,610.

Despite the many developments in backpacks, there remains a need for an efficient carrier of skis, boots and other ski clothing or ski equipment, including helmets, which backpack is lightweight, easy to pack and unpack, and comfortable to use.

SUMMARY OF THE PRESENT INVENTION

A new and improved backpack is provided which essentially includes a basic backpack shell construction, one having a stiff back panel supporting storage compartments projecting outwardly therefrom and carried on the user's back by a pair of shoulder straps and further secured to the user by a waist strap, to which basic shell a pair of tandem collapsible boot shelves or platforms are integrated at lower corner portions and an outer ski carrier and helmet mounting panel is hingedly attached to the front face of the basic backpack shell.

Specifically, the boot platforms are formed by a hinged, deployable boot wing panel which folds out from the shell to deploy a gusset extending between the shell and the boot wing panel. Fastening straps sewn to the inner surfaces of the boot wing panels include quick-release buckles which engage mating quick-release anchors on the shell to hold ski boots securely in place against the shell on the platforms. Advantageously, waterproof bonnets secured to the wing panels are provided to cover the open tops of the ski boots.

The auxiliary panel is specially configured to support and to secure a pair of skis with binders between the backpack shell and the inner surfaces of the auxiliary panel while permitting the lower extremities of the skis to project downwardly through an opening in the panel.

The outer surface of the auxiliary panel has a specially configured cushioned support system with an adjustable, bungee cord-tensioned stash panel for securing a hard ski helmet or other equipment/clothing to the front of the backpack.

For a more complete description of the invention and a better appreciation of its attendant advantages, reference should be made to the accompanying drawings along with the following detailed description.

DETAILED DESCRIPTION OF THE INVENTION

Figure 1:
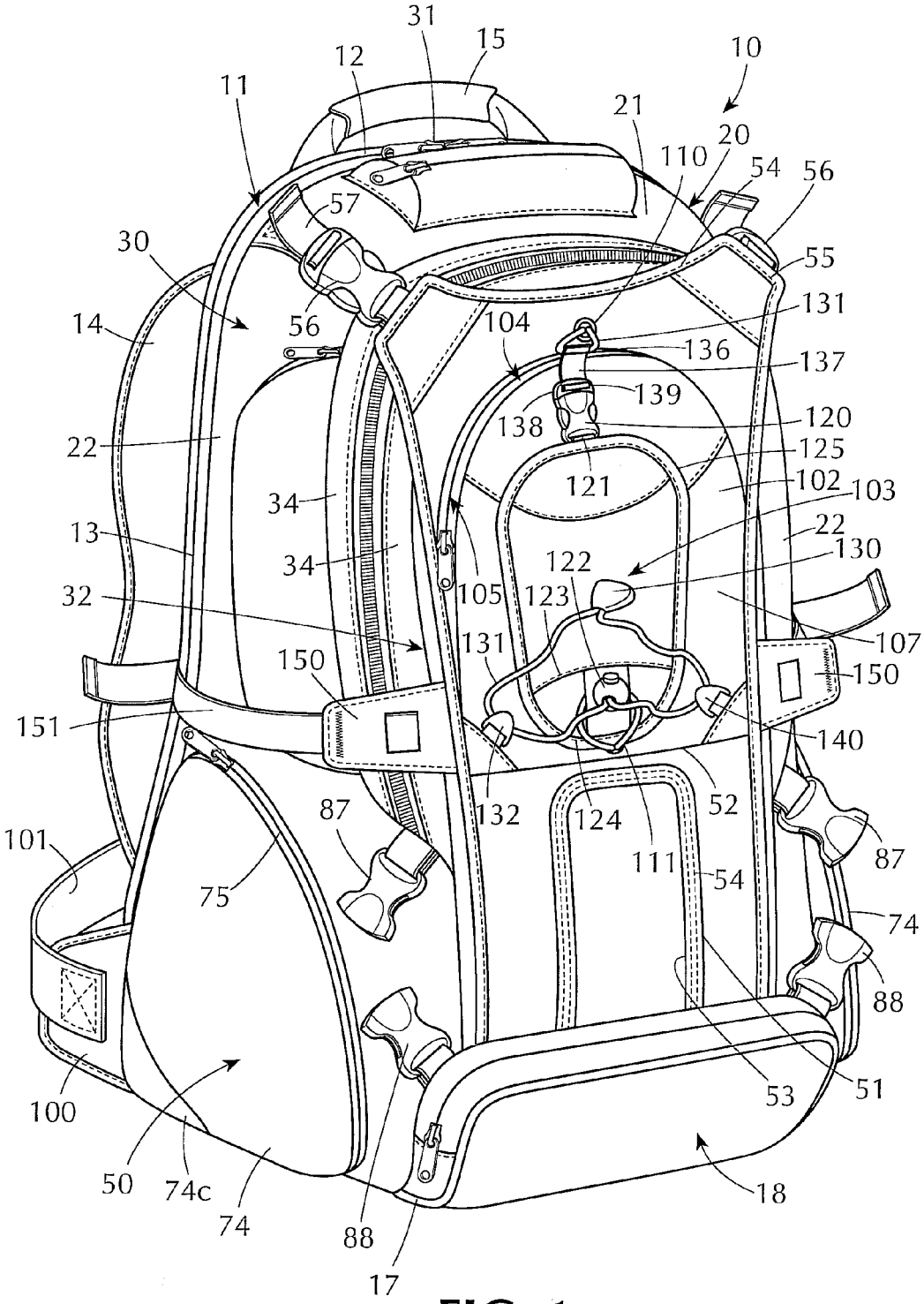
FIG. 1 is a perspective view of the new and improved backpack of the present invention in a closed condition without skis and ski boots loaded thereon.

The new backpack 10, as shown in FIG. 1, has a reinforced, stiffened back panel 11 which is a single, large, full height-full width panel defining the overall profile of the backpack and having an upper horizontal edge 12, side edges 13 and a lowermost edge (not visible in FIG. 1).

Figure 2:
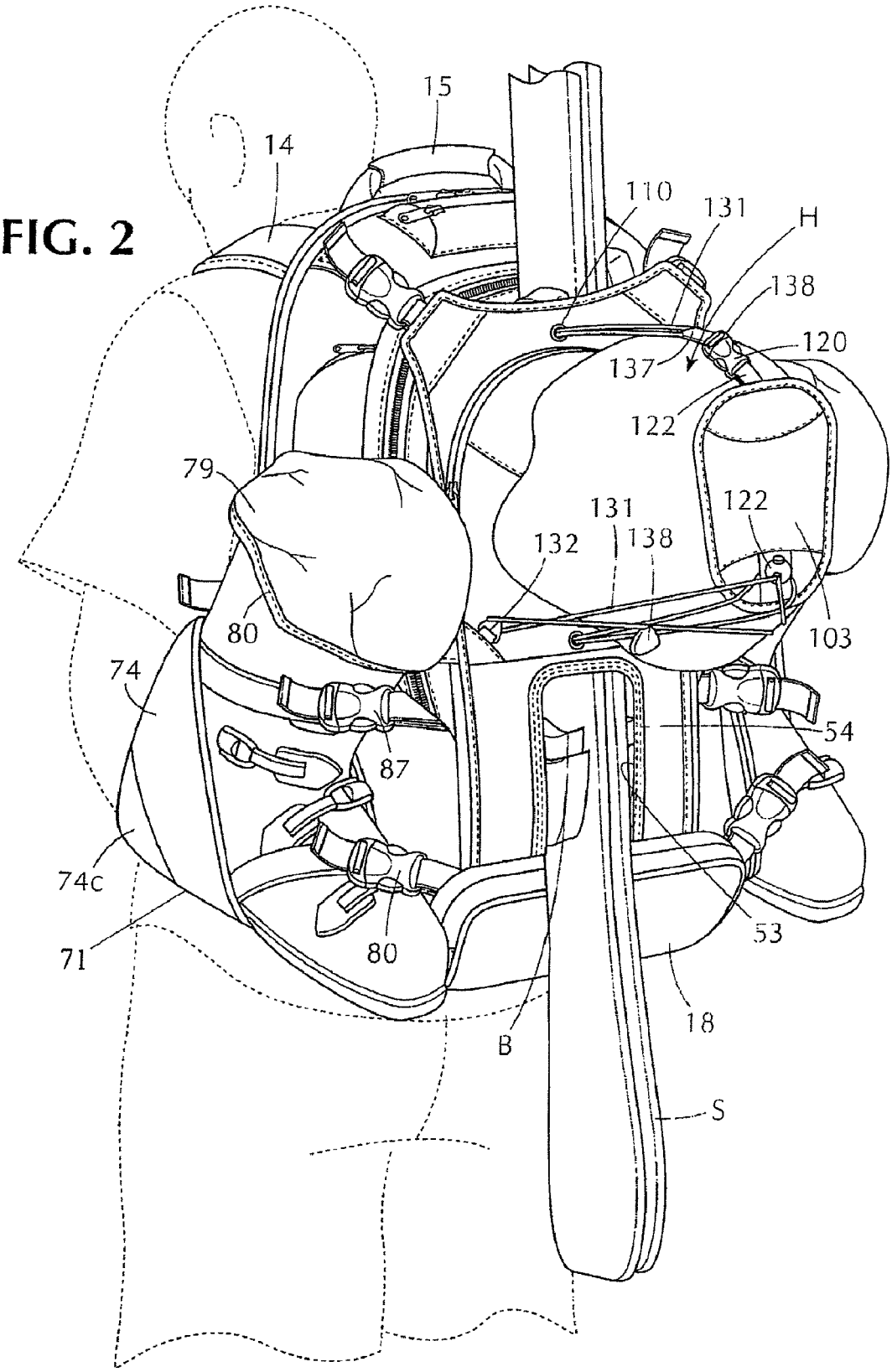
FIG. 2 is a perspective view of the new backpack with skis, ski boots and a ski helmet loaded thereon.

A pair of spaced shoulder straps 14 are secured symmetrically at the upper and lower sides of the rear panel 11 for carrying the backpack on the shoulders of a user in known and conventional fashion. A simple handle 15 is secured at the upper portions of the rear panel for lifting and carrying the backpack as hand luggage. A bottom wall panel 17 extends from the rear wall 11 to the front of the backpack 10 and has an upwardly extending lip 18 to which a zip-opening, lower stash pouch 49 is integrally connected. A generally U-shaped side wall panel 20 having a top wall 21 and side walls 22 extends from the edges of the bottom panel 17 upwardly and around and back downwardly to the edges of the bottom panel 17 to establish the sides of the backpack. An interior full-depth wall (not shown) extends for the full depth of the backpack and together with the bottom wall 17, the side walls 22, top wall 21 and rear wall 11 defines a major stowage compartment of the backpack which stowage compartment is indicated by numeral 30. This major stowage compartment 30 is accessed through a zipper closure 31 which extends along the top edge of the backpack and down one vertical side thereof. If desired, the inner surfaces of the major stowage compartment 30 may be provided with additional pockets and/or holding straps as desired or deemed necessary to secure equipment of a skier/hiker. An upper stash pouch 38 with a central zipper 39 for access is sewn to the top wall 21 as shown in FIGS. 1, 2 and 4.

Figure 4:
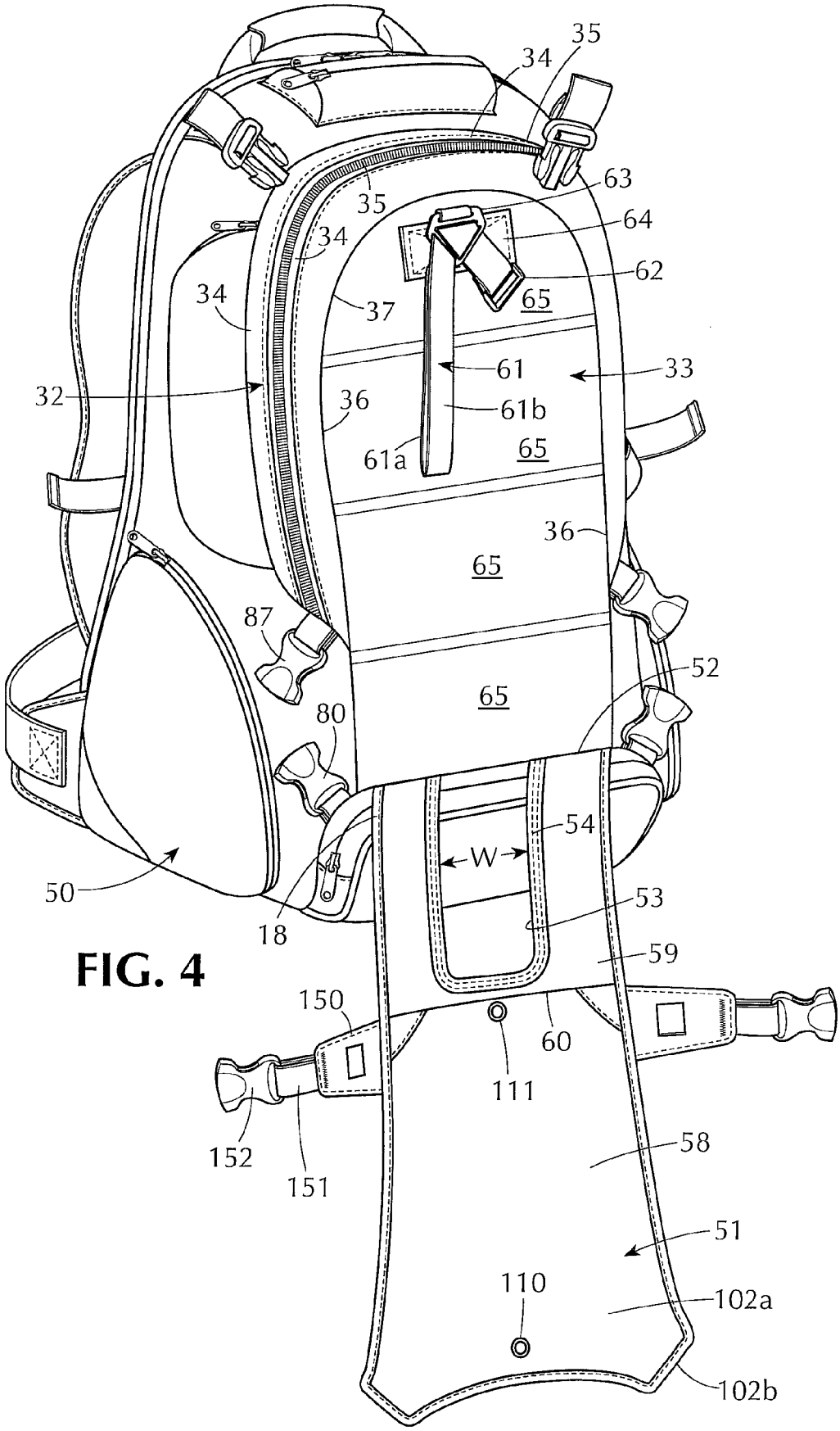
FIG. 4 is a perspective view of the new ski backpack with the auxiliary ski-securing panel unfolded to permit loading of skis.
Figure 5:
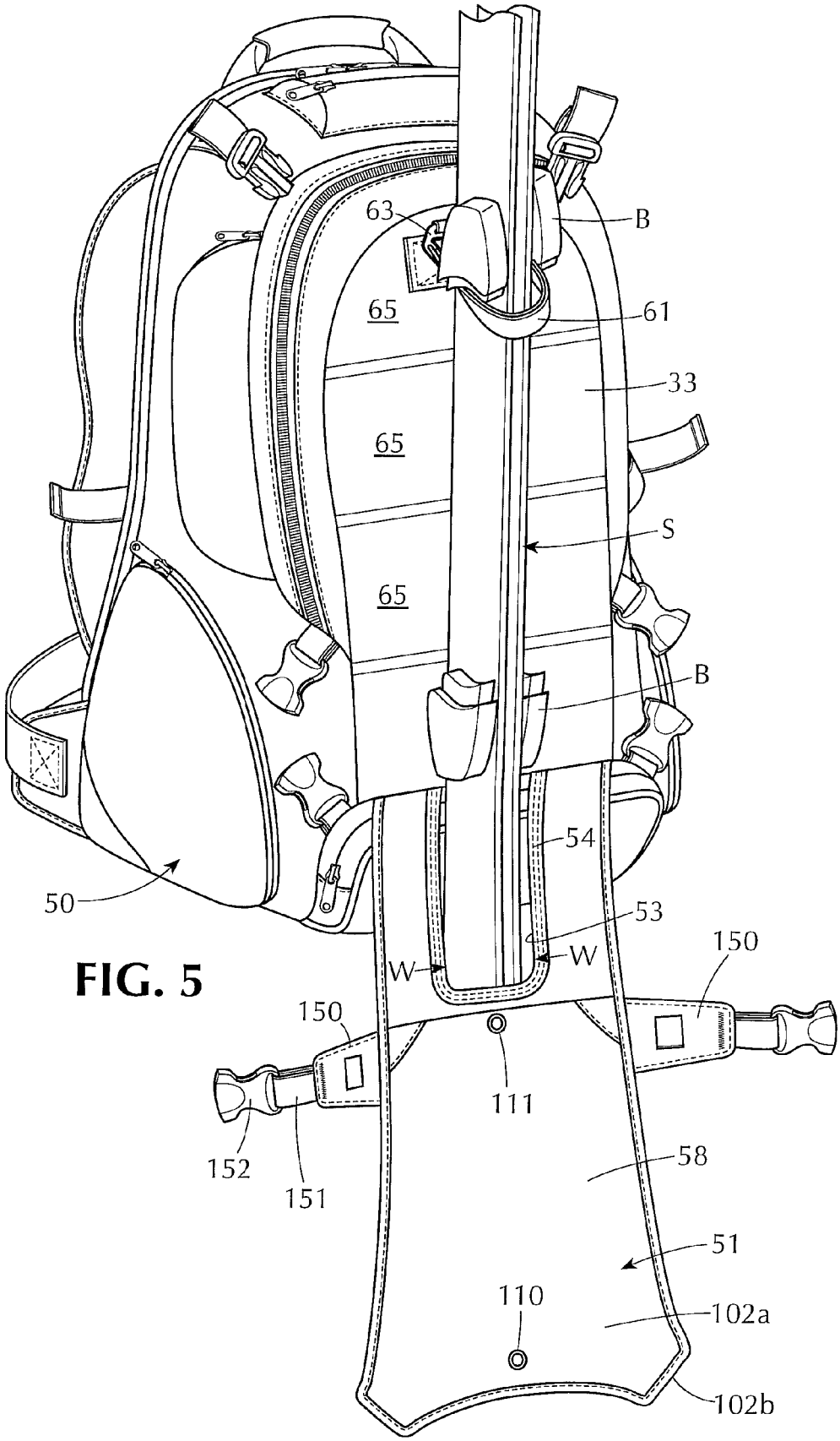
FIG. 5 is a perspective view of the new backpack with skis loaded thereon prior to closing the auxiliary front panel.

A minor stowage compartment 32 is formed adjacent and integrally with the major stowage compartment 30 by a front wall 33 which extends upwardly from the stash pouch 18 and is sewn along its side edges 36 and upper edge 37 to a circumscribing wall 34, as shown in FIG. 4. The minor stowage compartment 32 is accessed by a U-shaped zipper 35 which divides the wall 34 and provides access to the minor stowage compartment 32. As described thus far, it will be appreciated that the overall shell of the backpack 10 is of generally conventional construction having stowage compartments formed by a supporting back panel 11, a bottom panel 17, side panels 21, 22, 34 and front panel 33.

In accordance with the principles of the present invention, a new and improved backpack construction is established for carrying both snow skis and ski boots as well as a rigid ski helmet (or other equipment/clothing) by the provision of special deployable ski boot platforms 71 stored in boot platform pouches 50 and an auxiliary front or ski harness panel 51. The lower edge 52 of the ski harness panel 51 is sewn to and hinged along the lower edge of the front backpack panel 33. In accordance with the invention, the panel 51 has an elongated U-shaped port 53 formed at the bottom thereof. The width "W" of the port is slightly greater than the back-to-back thickness of a sandwiched pair of skis "S" to be carried but substantially less than the dimensions of ski bindings "B" mounted on the skis. The edges of the open port 53 are reinforced by welting 54 sewn along the edges thereof. The upper edge of the ski harness panel is concave in shape terminating at oblique edge portions 55 to which quick-release hardware sockets 56 are securely mounted. The locking sockets are adapted to engage mating quick-release locking hardware blades 57 attached adjacent the rear top edges of the backpack by adjustable length straps 57*a*.

All of the quick-release hardware shown and described herein is of the type having one piece molded male members with fingers engaging a hollow female socket. The male members have a central elongate guide 100 and twin compressible, resilient fingers 86 (FIG. 3) projecting from a body portion usually including a locking bar in a slot through which a web strap may be threaded. The effective length of the web strap may be adjusted in known manner such as described in U.S. Pat. No. 5,309,610, incorporated herein by reference. The fingers of the male member are quickly engageable or releasable by from a one-piece molded plastic mating socket having slots for engaging and holding the ends of the fingers. This hardware is well-known to the art and need not be described in additional detail. Hereinafter, reference will be made to quick-release buckles or hardware.

The ski harness panel 51 is divided into an upper section 58 and a lower section 59 along a flexible hinge seam 60. Advantageously, the upper portion 58 is made of two comparatively flexible fabric layers, front face 102 and rear face 102*a*, sewn together about the periphery 102*b*. A grommet 110 is secured to reinforce an opening at the top of panel 58 while a grommet 111 is secured in an opening at the bottom of the panel, both providing access between the layers 102, 102*a*.

The lower portion 59 containing the ski port 53 is made of comparatively more rigid, non-elastic material which may be appropriately stiffened or reinforced. In accordance with the invention, the entire panel 51 may be hinged along the hinge line 52 in the manner shown in FIG. 4 to prepare the backpack for loading of the skis. The front panel 33 of the backpack contains or otherwise mounts at its upper portions an adjustable ski securing strap 61 with hooked and looped fastening tape ("Velcro") portions 61*a*, 61*b* and a tightening buckle 62 which are mounted to the front panel by an appropriate triangular clip 63 and mounting strip 64.

Cushioning pads 65 of elastomeric foam material are sewn into or otherwise incorporated with the front panel 33 for both engaging the carried skis and providing protection to the contents of the minor stowage compartment 32.

Figure 3:
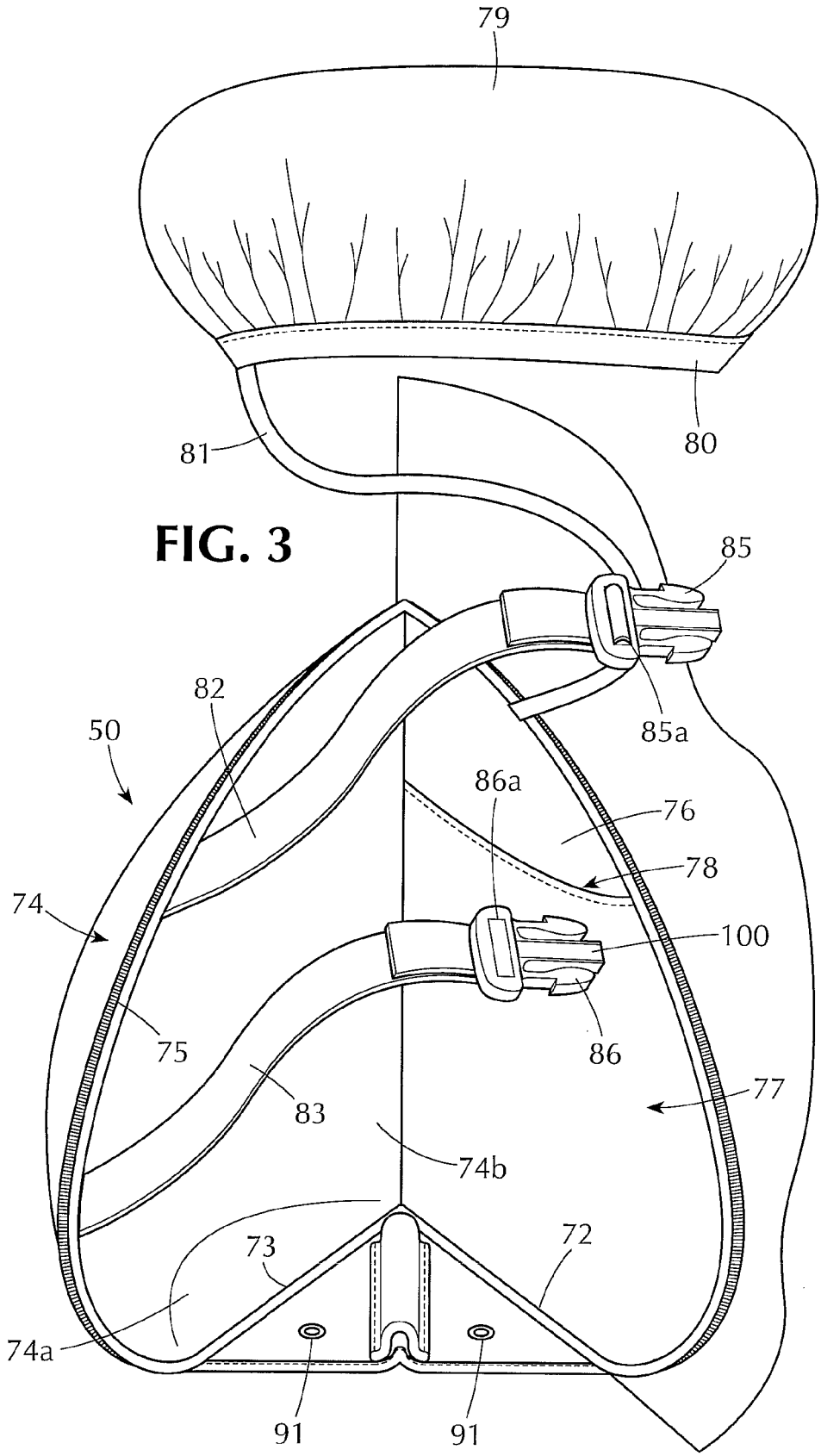
FIG. 3 is a side elevational view of the ski boot platform deployed to receive a ski boot.

As an important part of the invention, ski boots may be carried externally of the shell of the backpack as shown in FIG. 2 by deploying a ski boot support system shown in FIG. 3 comprised of a ski boot platform 71 in the nature of a gusset sewn on its inner end to the bottom of the backpack shell along a seam 72 and sewn on its opposite side along a seam 73 to the outer wall of a ski boot pouch panel 74. The pouch panel 74 is generally pyramidal or three-dimensional in shape and is connected by a zipper 75 to an inner boot pouch wall 76. The pouch panel 74 includes a lowermost portion 74*a* which is deployable in the horizontal plane of the gusset 71 (to support the heel of a ski boot) and a vertical wall portion 74*b* (to engage the back of the ski boot). A reinforcing corner piece 74*c* of durable fabric is sewn to the rear lower portion of the pouch panel 74.

A fabric layer 77 overlays the panel 76 to form a flat sleeve 78 therebetween in which a flexible, waterproof ski boot bonnet 79 is stored. The bonnet 79 is in the nature of a flexible shower cap having an elastic band 80 at its bottom which may be expanded to stretch over the open top of the ski boot as will be explained hereinafter. The ski boot bonnet 79 is permanently attached to the panel 76 by an elastic cord 81 to prevent its being separated and lost. Under normal circumstances, when the ski boots are not being carried, the bonnet 79 is merely folded and inserted in the sleeve 78 as will be understood.

The ski boot support system further includes fastening straps 82, 83 which are sewn to the pouch panel 74 and include male quick-release hardware members 85, 86 at their free ends. The effective lengths of the straps 82, 83 can be adjusted by lengthening or shortening them effectively through bars in the bodies of the quick-release locking members 85, 86 in known fashion. The quick-release locking members 85, 86 when deployed are adapted to be connected to mating socket hardware 87, 88, respectively, which are mounted at lower portions of the backpack adjacent the boot panel 74. A mirror image deployable boot support system is formed on the opposite side of the backpack for mounting the second ski boot of the user as will be understood.

Adjacent the lowermost portions of the back panel are wings 100 (only one of which is shown) which mount waist belts 101 which extend forwardly from the wings 100 and include quick-release hardware at the free end thereof (not shown). The waist belts 101 may be cinched at the waist portions of the wearer to further secure the backpack to the user after the shoulder straps have been put on the user and the load carried. The waist belts 101 are of generally conventional construction as are the shoulder straps and provide the means by which the entire backpack 10 is secured to the skier carrying the load of the backpack 10.

The face 102 along with the upper portion 58 of the ski harness panel 51 forms yet another equipment pocket 104 which may be accessed by a circumscribing zipper 105.

As a further feature of the invention, the front face 102 of the auxiliary panel 51 mounts in adjustable spaced relation thereto a cushioned stash panel 103 which is tethered to the ski harness panel 51 by a unique bungee cord arrangement. A locking buckle 120 is secured hingedly to the upper portions of the stash panel by a sewn tab 121. A grommet 112 is mounted on an anchor strap 122 sewn in slightly spaced relation to the face of the panel 103 by lines of stitching 123, 124, the stitching 124 also securing a circumscribing welting 125.

The bungee arrangement is formed by a closed or "endless" elastomeric bungee cord loop 131 extending from a hardware tab 130 through a first cord guide 132 on fabric web tab 133 sewn to lower corner of the panel 102 then through cord lock 134 having spring-loaded cord clamp 135. From the lock 134, the cord 131 continues through the grommet 112 then back down and through the grommet 111 entering the space between the layers 102, 102*a*. The cord continues upwardly and back out from between the layers 102, 102*a* through the grommet 110 and goes through a sewn loop 136 formed at the upper end of a web tab 137 having a male locking buckle 138 secured to its lower end through a separate sewn loop 139.

The cord 131 after passing through the loop 136 is threaded back through the grommet 110 and extends downwardly between the layers 102, 102*a* and out through the grommet 111. From there, the cord 131 continues behind the strap 122 and back out through the grommet 112 and through the cord lock 134 from where it extends through a second cord guide 140 and back into the hardware tab 130 forming the bungee loop.

With the hardware 138, 120 connected, the stash panel 103 is floatingly spaced from the front panel 102 by the endless bungee loop 131, the tension of which can be readily adjusted by increasing or decreasing the size of the loop by pulling on the tab 130 after releasing the cord clamp 135 and then reclamping the cord at a desired size as will be described hereafter with regard to securing a helmet to the backpack shell by sandwiching it between the stash panel 103 and front panel 102.

In use, all the backpack stowage compartments and stash pouches of the backpack shell may be loaded with ski gear through the zippered access thereto as will be readily understood. After the gear is loaded, snow skis, ski boots, and a hard helmet may be simply and quickly loaded, in accordance with the principles of the invention, as follows.

Ski boots may be externally secured on each side of the bottom of the gear-loaded backpack by unzipping the zipper 75 and pulling the boot pouch panel 74 outwardly away from the backpack shell. In so doing, the gusset platform 71, advantageously formed of two panels 71*a*, 71*b* joined by a welt 72*c*, is deployed between the walls 74, 76. Drainage ports 91 are formed in the gusset. The pouch panel portions 74, 74*a*, 74*b*, along with the gusset platform 71, and panel 76 form a frontwardly open boot pouch. A ski boot can then be supported in the boot pouch with its heel on the platform 71 and portion 74*a* and its ankle portions between the panels 74, 76 with the back of the boot against portion 74*b*. The boot may then be firmly secured in place by straps 82, 83, whose length may be adjusted by the openings 85*a*, 86*a* in the buckle hardware 85, 86. The buckles 85, 86 are locked to mating hardware sockets 87, 88 on the backpack shell (FIG. 2).

Thus, it will be appreciated that the bulky and heavy ski boots may be carried externally of the internally stowed gear which is especially important when the boots may be dirty and damp from snow and/or perspiration after usage. To keep the tops of the stowed boots closed and safe from the elements during transport, the bonnet 79 may be removed from storage and placed over the boot tops and held lightly by the elastic band 80. The tether 81 keeps the bonnet from being lost.

Figure 6:
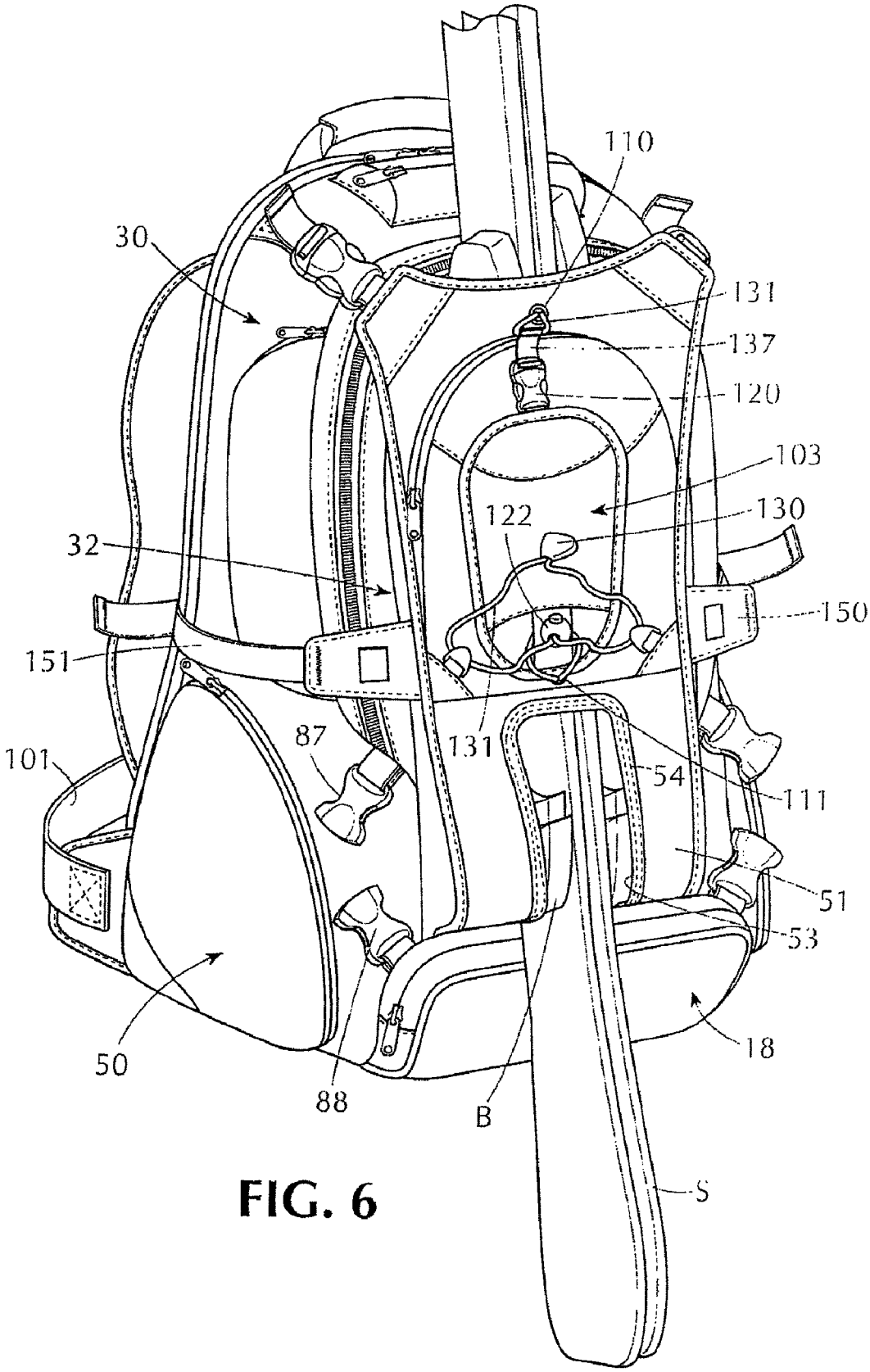
FIG. 6 is a perspective view showing the backpack with the skis loaded thereon and the auxiliary front panel secured with skis projecting beyond the uppermost and lowermost portions of the new backpack.

To load a pair of skis to the backpack shell, the auxiliary panel 59 is folded outwardly exposing the front panel 33 and the securing strap 61. The bottom portion of skis are projected through the port 53 with the bindings "B" prevented from passing through the port 53 and advantageously supported by the reinforced or stiffened panel portion 59 when the auxiliary panel is folded upwardly and toward the front panel 33 as shown in FIG. 6. The upper portions of the skis are locked against the panel 33 and the cushioned portions 65 by tightening the straps 61 around the skis and beneath the bindings "B."

To secure the skis in place, the auxiliary panel is buckled tightly at its upper ends through hardware 56 to mating hardware 57 on adjustable length straps 57*a*. The entire packed shell as well as the mounted skis are further secured and tightened by adjustable compression straps 150, 152, having a locking buckle which mates with complementary hardware 152 on web 153 extending from the back panel 11.

With the boots and skis loaded onto the backpack through the new and improved construction, a ski helmet or other gear may be mounted on the auxiliary panel itself by clamping the helmet or other gear between the stash panel 103 and the front face 102 of the auxiliary ski-securing panel. The panel 103 is flexible enough to conform generally to the contours of a helmet or other rigid gear and the tension by which the panel 103 is urged toward the face 102 may be adjusted by variations in the effective length of the bungee cord 131. The cord itself in its exposed lower portions between the cord lock 122 and cord guides 132, 140 provides additional support. The quick release and/or quick reloading of gear may be effected by the uncoupling or recoupling of the quick release hardware 120, 138.

It will be appreciated that the new and improved ski gear backpack provides effective and efficient attachment of skis, boots, and helmets or other bulky gear to a backpack shell. The new construction permits quick and easy loading and unloading of the equipment required for skiing.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. A backpack for skiing gear comprising:

(a) a shell having a rigid back walk a bottom wall, a top wall, a front wall, and opposite side walls defining a closed stowage space;

(b) an auxiliary ski-harness panel having upper and lower portions is hinged to the front wall of the shell;

(c) the lower portion is substantially rigid and defines a preformed, reinforced aperture serving as an elongated ski port in a central portion of said lower portion of said auxiliary ski-harness panel;

(d) the width of said port exceeding the back-to-back depth of a pair of skis but being less than the depth of bindings on the skis;

(e) harness anchor buckle means attached to the top wall of said shell;

(f) ski strap means attached to the shell front wall and adapted to engage and secure juxtaposed skis to said front wall;

(g) the upper portion of said ski harness panel being hinged to the lower ski harness portion and adapted to engage skis positioned between the shell front wall and the ski harness panel;

(h) adjustable harness strap means attached to the upper portion of said ski harness panel and having buckle means adapted to mate with said harness anchor buckle means; and (i) whereby a pair of skis with bindings may be secured to the backpack with the load transferred through said ski harness panel.

2. The backpack of claim 1, further including:

(a) adjustable compression strap means extending between the ski harness panel and the back wall of the shell;

(b) said compression strap means being adapted to tighten the load between said harness panel and said back wall.

3. The backpack of claim 1 further comprising:

(a) first and second collapsible ski boot receptacles secured to opposing external of said side walls at lower portions thereof;

(b) said first and second ski boot receptacles including a pyramidal-shaped pouch element having a three-sided pouch wall portion having a vertical edge, a horizontal edge and a third edge extending therebetween;

(c) the vertical edge of said pouch wall portion fastened to the shell;

(d) zipper means selectively connecting a remaining edge of the pouch wall portion to the shell and whereby the pouch element forms a flattened pouch with the shell; and (e) foldable platform gusset means attached to the horizontal edge of the pouch wall portion and the shell, whereby upon unzipping said zipper means and folding the pouch wall portion outwardly therefrom, about receptacle adapted to engage and support a boot is established externally of the shell.

4. The backpack of claim 1 wherein said auxiliary ski-harness panel is hingedly attached to said front wall of the shell in a manner to permit vertical rotation of said ski-harness panel approximately 180 degrees.

5. The backpack of claim 1 wherein said port is adapted to secure said skis in a substantially perpendicular orientation with respect to the ground.

6. The backpack of claim 1, further including:

(a) stash panel means; and (b) tethering means adjustably securing said stash panel means to said upper portion of said ski harness panel.

7. The backpack of claim 6, in which:

(a) said tethering means includes an elastomeric bungee cord and adapted to apply tensioning force to said stash panel means.

8. The backpack of claim 7, including:

(a) cord guide means secured to the harness panel in tandem and in lateral relation to said stash panel means;

(b) said bungee cord means being supported in said guide means.

9. The backpack of claim 7, in which:

(a) said bungee cord means is in the form of a closed loop;

(b) portions of said loop extend through and behind said ski harness panel; and (c) cord locking means receiving portions of said loop extending therethrough;

(d) whereby the effective size of the cord loop may he adjusted by the positioning of the cord locking means to change the tensioning force.

10. A backpack for skiing gear comprising: (a) a shell having a rigid back wall, a bottom wall, a top wall, a front wall, and opposite side walls defining a closed stowage space; (b) first and second collapsible ski boot receptacles secured to external surfaces of said side walls at lower portions thereof; (c) said first and second receptacles including a pyramidal-shaped pouch element having a three-sided pouch wall portion having a vertical edge, a horizontal edge, and a third edge extending therebetween; (d) the vertical edge of said pouch wall portion fastened to the shell; (e) zipper means selectively connecting a remaining edge of the pouch wall portion to the shell and whereby the pouch element forms a flattened pouch with the shell; (f) foldable platform gusset means attached to the horizontal edge of the pouch wall portion and the shell, whereby upon unzipping said zipper means and folded the pouch wall portion outwardly therefrom, a boot receptacle adapted to engage and support a boot is established externally of the shell; (g) an auxiliary ski-harness panel having upper and lower portions is hinged to the front wall of the shell; (h) the lower portion is substantially rigid and defines a pre-formed, reinforced aperture serving as an elongated ski port in a central portion of said lower portion of said auxiliary ski-harness panel; (i) the width of said port exceeding the back-to-back depth of a pair of skis but being less than the depth of bindings on the skis; (j) harness anchor buckle means attached to the top wall of said shell; (k) ski strap means attached to the shell front wall and adapted to engage and secure juxtaposed skis to said front wall; (l) the upper portion of said ski harness panel being hinged to the lower ski harness portion and adapted to engage skis positioned between the shell front wall and the ski harness panel; (m) adjustable harness strap means attached to the upper portion of said ski harness panel and having buckle means adapted to mate with said harness anchor buckle means; and (n) whereby a pair of skis with bindings may be secured to the backpack with the load transferred through said ski harness panel.

11. The backpack of claim 10, further characterized in that (a) at least one fastening strap with a locking buckle is connected to said pouch element along said remaining edge portion; and (b) at least one anchor buckle adapted to engage and to secure said locking buckle is attached to the shell proximate to said pouch element.

12. The backpack of claim 10, in which (a) a bonnet means adapted to close the top of a hoot is secured to the shell by a tether; and (b) said bonnet is adapted to he stored.

* * * * *